US008549770B2

(12) United States Patent
Bellinger et al.

(10) Patent No.: US 8,549,770 B2
(45) Date of Patent: Oct. 8, 2013

(54) APPARATUS AND METHOD OF DRYING LAUNDRY WITH DRYING UNIFORMITY DETERMINATION

(75) Inventors: Ryan R. Bellinger, Saint Joseph, MI (US); Andrew E. Spangler, Saint Joseph, MI (US); Christopher J. Woerdehoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 222 days.

(21) Appl. No.: 13/222,455

(22) Filed: Aug. 31, 2011

(65) Prior Publication Data

US 2011/0308103 A1 Dec. 22, 2011

Related U.S. Application Data

(63) Continuation-in-part of application No. 12/641,519, filed on Dec. 18, 2009, now Pat. No. 8,245,415, and a continuation-in-part of application No. 12/641,480, filed on Dec. 18, 2009.

(51) Int. Cl.
*F26B 3/00* (2006.01)

(52) U.S. Cl.
USPC ..... 34/486; 34/528; 34/543; 34/595; 34/606; 68/20; 8/159

(58) Field of Classification Search
USPC ..... 34/486, 489, 497, 595, 527, 528, 543, 34/601, 603, 606; 68/5 R, 18 R, 20; 8/137, 8/159; 236/44 E; 219/497, 686, 400
See application file for complete search history.

(56) References Cited

U.S. PATENT DOCUMENTS

| | | | | | |
|---|---|---|---|---|---|
| 2,142,042 | A | * | 12/1938 | Bowdoin et al. | 34/486 |
| 3,417,480 | A | * | 12/1968 | Thunander | 34/528 |
| 3,702,030 | A | * | 11/1972 | Janke | 34/498 |
| 4,006,535 | A | | 2/1977 | Nelson | |
| 4,041,614 | A | | 8/1977 | Robinet | |
| 4,231,166 | A | * | 11/1980 | McMillan | 34/553 |
| 4,275,508 | A | | 6/1981 | Jones | |
| 4,642,908 | A | | 2/1987 | Brenner | |
| 5,172,490 | A | | 12/1992 | Tatsumi et al. | |
| 5,245,764 | A | | 9/1993 | Sung | |
| 5,276,978 | A | | 1/1994 | Hopkins et al. | |
| 5,291,667 | A | * | 3/1994 | Joslin et al. | 34/526 |
| 5,396,715 | A | | 3/1995 | Smith | |
| 5,560,124 | A | | 10/1996 | Hart et al. | |
| 5,651,192 | A | | 7/1997 | Horwitz | |
| 5,724,750 | A | | 3/1998 | Burress | |

(Continued)

FOREIGN PATENT DOCUMENTS

| | | | |
|---|---|---|---|
| DE | 19961459 | A1 | 7/2001 |
| DE | 102006025952 | A1 | 12/2007 |

(Continued)

OTHER PUBLICATIONS

German Search Report for corresponding DE102010017232, Dec. 22, 2011.

*Primary Examiner* — Steve M Gravini
(74) *Attorney, Agent, or Firm* — Clifton G. Green; McGarry Bair PC

(57) ABSTRACT

An apparatus and method of drying laundry in a treating chamber with a partially dry laundry load determination.

20 Claims, 9 Drawing Sheets

(56) References Cited

U.S. PATENT DOCUMENTS

| | | | | |
|---|---|---|---|---|
| 5,755,041 | A | 5/1998 | Horwitz | |
| 5,899,005 | A * | 5/1999 | Chen et al. | 34/528 |
| 5,953,831 | A | 9/1999 | Yu | |
| 5,958,494 | A | 9/1999 | Tidland et al. | |
| 6,047,486 | A | 4/2000 | Reck et al. | |
| 6,067,729 | A | 5/2000 | Willis | |
| 6,122,840 | A | 9/2000 | Chbat et al. | |
| 6,158,148 | A | 12/2000 | Krausch | |
| 6,223,452 | B1 | 5/2001 | Hamand | |
| 6,401,357 | B1 | 6/2002 | Smith et al. | |
| 6,519,871 | B2 | 2/2003 | Gardner et al. | |
| 6,584,633 | B2 | 7/2003 | Chute et al. | |
| 6,715,216 | B1 | 4/2004 | Salameh et al. | |
| 6,751,888 | B2 | 6/2004 | Lueckenbach | |
| 6,757,988 | B2 * | 7/2004 | Bruntz et al. | 34/543 |
| 6,784,997 | B2 | 8/2004 | Lorenz et al. | |
| 6,840,069 | B2 | 1/2005 | France et al. | |
| 6,898,951 | B2 | 5/2005 | Severns et al. | |
| 7,020,982 | B2 | 4/2006 | Park et al. | |
| 7,043,855 | B2 | 5/2006 | Heilman et al. | |
| 7,257,905 | B2 | 8/2007 | Guinibert et al. | |
| 7,448,145 | B2 | 11/2008 | Kim | |
| 7,478,486 | B2 * | 1/2009 | Wunderlin et al. | 34/491 |
| 7,644,513 | B2 | 1/2010 | Bae et al. | |
| 7,765,715 | B2 * | 8/2010 | Kim | 34/491 |
| 7,908,766 | B2 * | 3/2011 | Ahn et al. | 34/595 |
| 7,942,025 | B1 | 5/2011 | Musone | |
| 8,015,726 | B2 | 9/2011 | Carow et al. | |
| 2002/0004995 | A1 * | 1/2002 | France et al. | 34/524 |
| 2002/0174564 | A1 * | 11/2002 | England | 34/606 |
| 2003/0101617 | A1 * | 6/2003 | Prajescu et al. | 34/527 |
| 2004/0006886 | A1 | 1/2004 | Lee et al. | |
| 2004/0119972 | A1 | 6/2004 | Smit-Kingma et al. | |
| 2004/0226187 | A1 * | 11/2004 | Bruntz et al. | 34/527 |
| 2005/0086826 | A1 | 4/2005 | Frushtick | |
| 2005/0097773 | A1 | 5/2005 | Gardner | |
| 2006/0191161 | A1 * | 8/2006 | Wunderlin et al. | 34/562 |
| 2006/0260064 | A1 | 11/2006 | Luckman et al. | |
| 2007/0193056 | A1 | 8/2007 | Switalski | |
| 2007/0209228 | A1 * | 9/2007 | Meerpohl et al. | 34/595 |
| 2007/0214678 | A1 | 9/2007 | Son et al. | |
| 2008/0120868 | A1 | 5/2008 | Morrison et al. | |
| 2009/0044422 | A1 | 2/2009 | Moschuetz et al. | |
| 2009/0071032 | A1 * | 3/2009 | Kreutzfeldt et al. | 34/389 |
| 2009/0126220 | A1 * | 5/2009 | Nawrot et al. | 34/497 |
| 2009/0159301 | A1 | 6/2009 | Chatot et al. | |
| 2009/0223082 | A1 | 9/2009 | Baek et al. | |
| 2009/0255142 | A1 * | 10/2009 | Brown | 34/79 |
| 2009/0272004 | A1 | 11/2009 | Chernetski et al. | |
| 2010/0000022 | A1 | 1/2010 | Hendrickson et al. | |
| 2010/0050464 | A1 | 3/2010 | Krzelowski et al. | |
| 2010/0139366 | A1 | 6/2010 | Krausch | |
| 2010/0205824 | A1 | 8/2010 | Ashrafzadeh et al. | |
| 2011/0047812 | A1 | 3/2011 | Sugimoto et al. | |
| 2011/0146101 | A1 | 6/2011 | Bellinger et al. | |
| 2011/0308103 | A1 * | 12/2011 | Bellinger et al. | 34/497 |
| 2012/0110869 | A1 * | 5/2012 | Bellinger et al. | 34/427 |
| 2013/0091726 | A1 * | 4/2013 | Kim et al. | 34/427 |

FOREIGN PATENT DOCUMENTS

| | | | |
|---|---|---|---|
| DE | 102008008797 | A1 | 8/2009 |
| EP | 0312065 | A1 | 4/1989 |
| EP | 0679754 | A2 | 11/1995 |
| EP | 915199 | A1 * | 5/1999 |
| EP | 1279760 | A2 | 1/2003 |
| EP | 1983086 | A2 | 10/2008 |
| EP | 2022893 | A2 | 2/2009 |
| FR | 2894996 | A1 | 6/2007 |
| JP | 02249598 | A * | 10/1990 |
| JP | 05177091 | A * | 7/1993 |
| JP | 5177095 | A | 7/1993 |
| JP | 5200194 | A | 8/1993 |
| JP | 6126099 | A | 5/1994 |
| JP | 7178293 | A | 7/1995 |
| JP | 10290898 | A | 11/1998 |
| JP | 2009078059 | A | 4/2009 |
| JP | 2009131786 | A | 6/2009 |
| JP | 2012228501 | A * | 11/2012 |
| KR | 20030012417 | A | 2/2003 |
| WO | 0194686 | A2 | 12/2001 |
| WO | 2007057360 | A1 | 5/2007 |
| WO | WO 2007141139 | A1 * | 12/2007 |
| WO | 2008000812 | A1 | 1/2008 |
| WO | 2008049534 | A1 | 5/2008 |
| WO | 2008148844 | A2 | 12/2008 |

* cited by examiner

APPARATUS AND METHOD OF DRYING LAUNDRY WITH DRYING UNIFORMITY DETERMINATION

RELATED APPLICATIONS

This application is a continuation-in-part of U.S. application Ser. Nos. 12/641,519, filed Dec. 18, 2009, entitled "Method for Determining Load Size in a Clothes Dryer Using an Infrared Sensor," and 12/641,480, filed Dec. 18, 2009, entitled "Method for Operating a Clothes Dryer Using Load Temperature Determined by an Infrared Sensor," which are incorporated by reference in their entirety.

BACKGROUND OF THE INVENTION

Laundry treating appliances, such as clothes washers, clothes dryers, and refreshers, for example, may have a configuration based on a rotating drum that defines a treating chamber in which laundry items are placed for treating according to a cycle of operation. The laundry treating appliance may have a controller that implements a number of pre-programmed cycles of operation having one or more operating parameters. The cycle of operation may be selected manually by the user or automatically based on one or more conditions determined by the controller.

In some laundry treating appliances, one or more operating parameters may be set based on a type, e.g. fabric type and/or fabric mix, of laundry placed inside of the treating chamber. The type of laundry may be provided by a user or automatically detected by the laundry treating appliance. In other laundry treating appliances, one or more operating parameters may be set based on the moisture content of the load of laundry. Commonly used sensors known as moisture strips are located in the treating chamber and detect the conductivity, and therefore the moisture, of the laundry during a cycle of operation.

SUMMARY

Disclosed are an apparatus and a method of drying laundry in a treating chamber with a partially dry laundry load state determination based on an infrared sensor temperature reading. The method of operating a laundry treating appliance according to a cycle of operation comprises tumbling the laundry load within the treating chamber, supplying heated air to the treating chamber to dry the laundry load, repeatedly sensing a surface temperature of the laundry load during tumbling to form a temperature signal, processing the temperature signal to form an upper envelope of the temperature signal and a lower envelope of the temperature signal, repeatedly determining a difference between the upper envelope and the lower envelope to form a difference signal, repeatedly comparing the difference signal to a partially-dry reference indicative of a portion of the laundry load being dry and initiating an operational action for the cycle of operation when the comparison indicates the laundry load is partially dry.

DESCRIPTION OF EMBODIMENTS OF THE INVENTION

Figure 1:
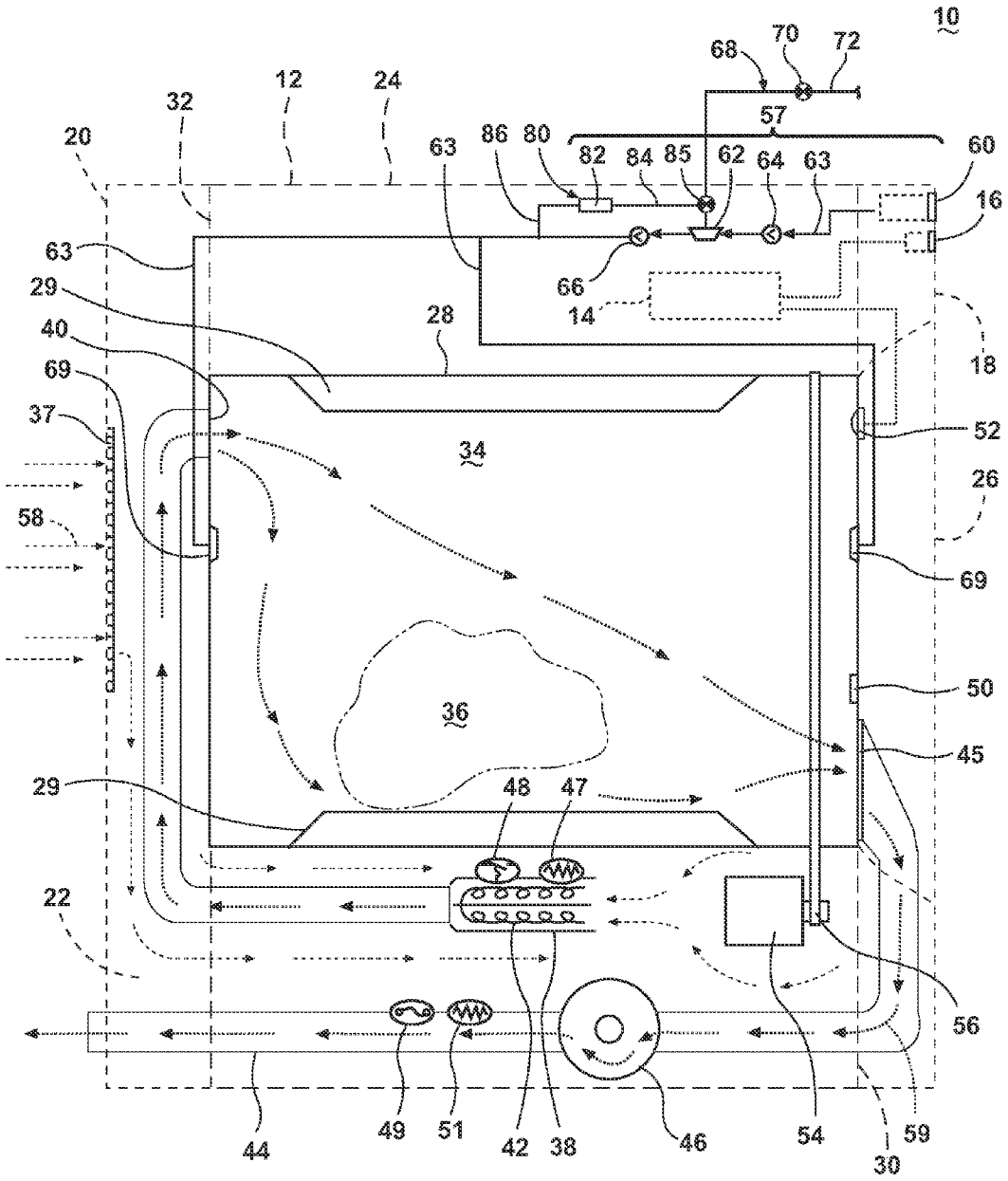
FIG. 1 is a schematic view of a laundry treating appliance in the form of a clothes dryer according to a first embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention. While the embodiments of the invention are described in the context of a clothes dryer 10, the embodiments of the invention may be used with any type of laundry treating appliance, non-limiting examples of which include a washing machine, a combination washing machine and dryer and a refreshing/revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34. The air system may further include an air exhaust portion that may be formed in part by an exhaust conduit 44.

A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to the outside of the clothes dryer 10.

A heating system may be provided to heat the air supplied by the heating system. The heating system may include a heating element 42 lying within the supply conduit 38 and may be operably coupled to and controlled by the controller 14. If the heating element 42 is turned on, the supplied air will be heated prior to entering the drum 28. The heating system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44, with the thermistor 51 being used to determine an outlet air temperature.

An optional moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

The clothes dryer 10 may also have a temperature sensor in the form of an infrared (IR) sensor 52 to determine the temperature of the treating chamber 34 and/or of the load of laundry 36 within the treating chamber 34. The IR sensor 52 measures the IR radiation of objects in its field of view; as the IR radiation increases, so does the object's temperature. The IR sensor 52 may be of an active or a passive sensor type, some non-limiting examples of IR sensor include: a thermopile, a narrow gap semiconductor photodetector, a quantum well IR photodetector, or any other known types of IR sensors.

The IR sensor 52 may be located on either of the rear or front bulkhead 30, 32 or in the door 26, and may be aimed toward an expected location of a load of laundry 36 within the treating chamber 34. As illustrated in FIG. 1, the IR sensor 52 may located in a top portion of the front bulkhead 32 and is aimed generally downwardly within the treating chamber 34. It may be readily understood that more than one IR sensor 52 may be used and may be provided in numerous other locations depending on the particular structure of the clothes dryer 10 and the desired position for obtaining a temperature reading.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges. A suitable cartridge system may be found in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," which is herein incorporated by reference in its entirety.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that the details of the dispensing system 57 and steam generating system 80 are not germane to the embodiments of the invention and that any suitable dispensing system and/or steam generating system may be used with the dryer 10. It is also within the scope of the invention for the dryer 10 to not include a dispensing system or a steam generating system.

Figure 2:
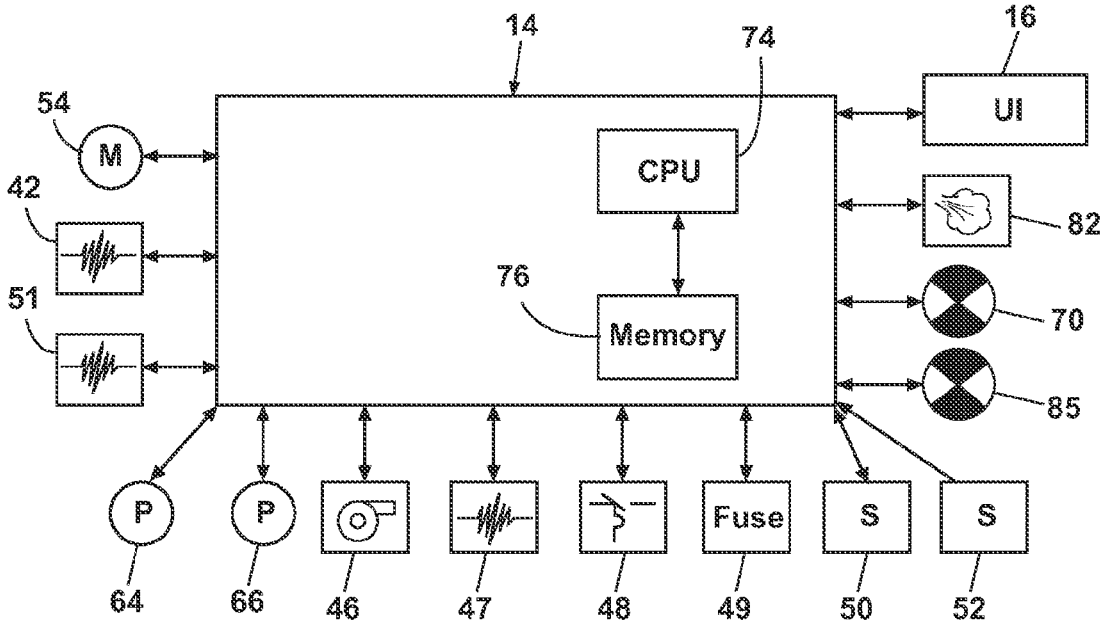
FIG. 2 is a schematic view of a controller of the clothes dryer in FIG. 1.

FIG. 2 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, moisture sensor 50, IR sensor 52, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 will effect a cycle of operation to effect a treating of the laundry in the treating chamber 34, which may or may not include drying. The controller 14 may actuate the blower 46 to draw an inlet air flow 58 into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry.

The determination of a "dry" load may be made in different ways, but is often based on the moisture content of the laundry, which is typically set by the user based on the selected cycle, an option to the selected cycle, or a user-defined preference. However, mixed load types do not dry in a uniform manner because of differences in the fabric types, weaves, thread counts, density, treatments/coatings, age, etc., which may impact absorbency and liquid retention characteristics. Even uniform loads can have some uniformity differences due to location in drum, tumble pattern, etc. but to a much lesser extent. This leads to situations where in order to dry all the items in the load, some of them will need to be over dried and subjected to more heat and tumbling than is necessary which both can affect the life of the garment(s).

The disclosed IR sensor 52 may resolve issues described above by assisting in determining a partially dry state of the laundry load 36 and/or a load type. More specifically, the temperature readings provided by the IR sensor 52 may be used to by the controller 14 to determine an intermediate condition of the drying laundry load 36, where some laundry items are dry and some are still wet. Hereafter, this condition of the laundry load will be referred to as the partially dry state. The controller 14 may also initiate an operational action for the cycle of operation upon determination of the partially dry laundry state. One non-limiting example of initiating an operational action is to notify a user when the partially dry laundry state is determined. The notification may be done via the user interface 16 by activating a visual and/or an audible indicator. This way, the user has an option of removing the dry items and continuing the cycle with the remaining wet items.

The controller 14 may also use data obtained by the IR sensor 52 to determine the load type in terms of how uniform the fabric types making up the laundry load 36 are. Mixed load types would typically dry in a less uniform matter than a uniform load type. The controller 14 may initiate an operational action for the cycle of operation by adapting or modifying one or more cycle parameters in dependence with the determined load type. Non limiting examples of those parameters are: as temperature setpoint(s), type and quantity of water or chemistry dispensing, tumble speed, airflow setpoint (s), end of cycle detection, etc, or a combination thereof. Also, similarly to above, the user may be notified of the determined load type via the user interface 16.

Before specific embodiments of the methods are presented, a description of techniques for determining the partially dry state of the laundry load 36 and the load type may be constructive. Those techniques are based on a uniformity of drying in the laundry load 36 which can be observed by the IR sensor 52 as temperature fluctuations in the load 36.

Figure 3:
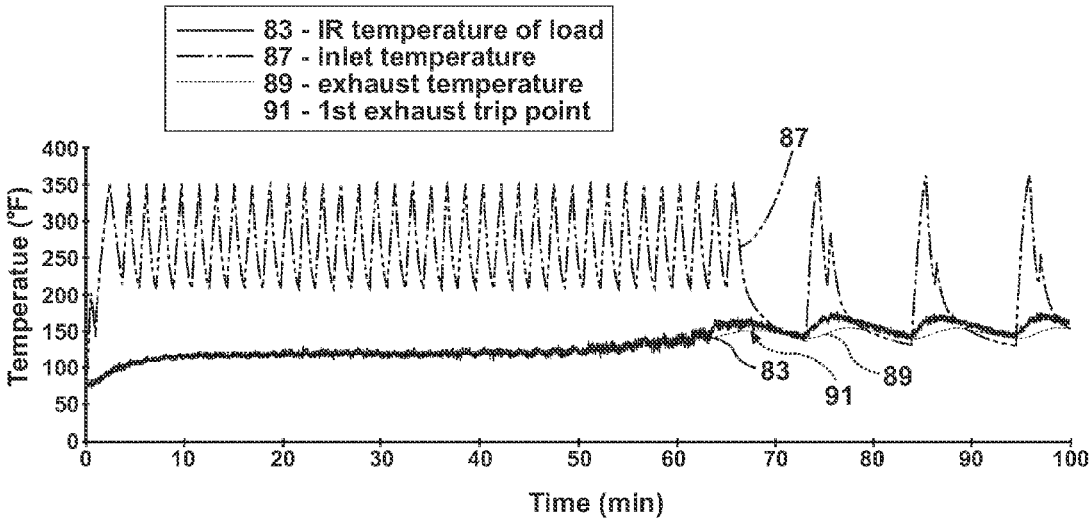
FIG. 3 is a graph of the temperature over time of a uniform 9 pound towel load, where the temperature is measured by various temperature sensors.

FIG. 3 is a graph of temperature signals obtained from various sensors for a 9 pound load of towels. Line 83 is a plot of the IR sensor signal for this load, line 87 is a plot of the inlet air temperature variations, and line 89 is a plot of the exhaust air temperature variations. Throughout a cycle of operation in the clothes dryer 10, the temperature of the laundry load 36 sensed by the IR sensor 52 varies. The temperature variation may exist for several reasons. One may be that the IR sensor 52 has a fixed field of view. The tumbling of the load as the drum 28 rotates results in a continuous change in the amount of laundry and the specific laundry items within the field of view of the IR sensor 52. Not all items of laundry nor all portions of a single item of laundry have the same temperature. Therefore, the temperature sensed by the IR sensor 52 may vary from reading to reading, even if the overall average temperature of the load does not significantly change. The tumbling of the load as the drum 28 rotates also results in a continuous change in the portion of the surrounding drum 28 within the field of view of the IR sensor 52. The temperature of the drum 28 may not always be the same as the temperature of the load of laundry. Collectively, the changing portions of the load and drum 28 in the field of view may cause temperature variations. The variation in the IR sensor signal increases slightly as a first exhaust trip point 91 is reached.

Figure 4:
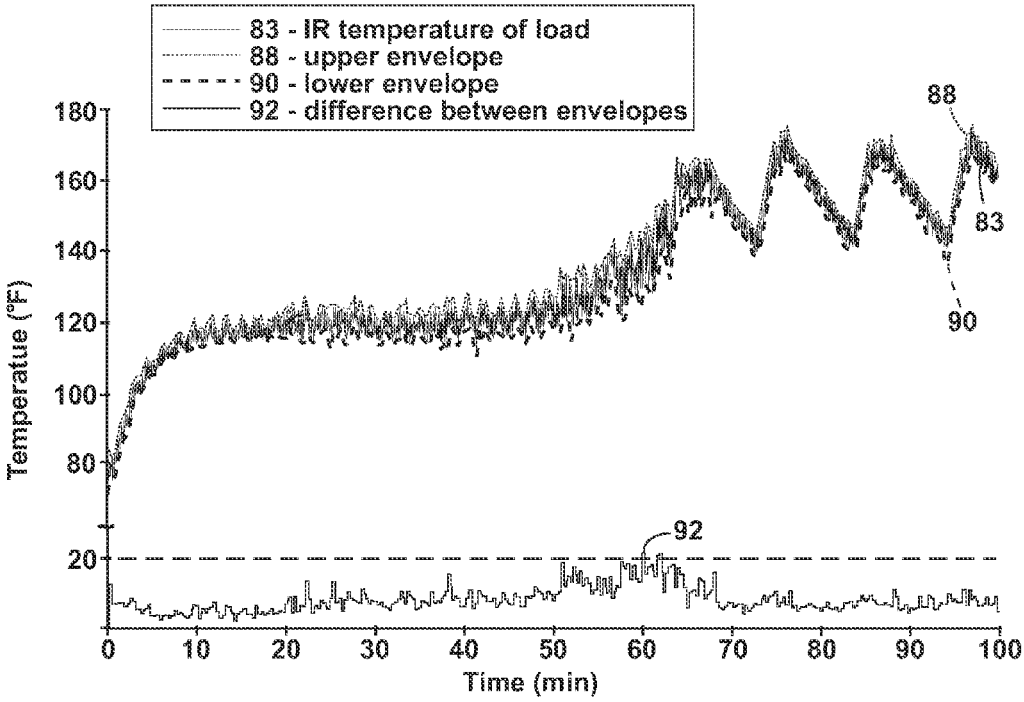
FIG. 4 is graph with an IR signal analysis for the uniform 9 pound towel load of FIG. 3.

FIG. 4 is a graph of an IR signal for the 9 pound towel load. In this and all subsequent graphs, line 83 represents the temperature of the laundry load 36. An upper envelope, represented by line 88, and a lower envelope, represented by line 90, can be created for the temperature 83. The upper envelope 88 may be determined from the local maximum values of temperature 83 and the lower envelope 90 may be determined from the local minimum values of temperature 83. The upper and lower envelopes 88, 90 may be calculated by monitoring the temperature values within a window of time based on a predetermined period, which may be, for example, 20 seconds. The highest value in the window is used as a data point for the upper envelope 88, while the lowest value in the window is used as a data point for the lower envelope 90. This is done for several windows of time to define multiple data points for the upper and lower envelopes 88, 90. The predetermined period may be adjustable since the maximum and minimum temperature values are dependent on the window of time.

In the case of a window of 20 seconds, for example, the IR sensor 52 may observe multiple tumbles of the load within its field of view and may have a higher chance of reading the temperature of the hottest area of the load that tumbled. However, if the window is smaller, for example if the window is 0.5 seconds or less, the IR sensor 70 may only be able to read the temperature of the load at a specific point during the tumble pattern since the drum 28 may not make a full rotation in that time.

More specific description of the creating the upper and lower envelope for the IR Sensor may be found in U.S. application Ser. No. 12/641,519, filed Dec. 18, 2009, entitled "Method For Determining Load Size In A Clothes Dryer Using An Infrared Sensor," and U.S. application Ser. No. 12/641,480, filed Dec. 18, 2009, entitled "Method For Operating A Clothes Dryer Using Load Temperature Determined By An Infrared Sensor" both assigned to Whirlpool Corporation, which are herein incorporated by reference in their entirety.

The difference between the upper and lower envelopes 88, 90 is representative of the temperature variation for the load over time, and is represented by line 92. This difference provides a simple metric for variation in the IR signal. The IR range calculation shown at the bottom of FIG. 4 demonstrates how the variation in the signal is well below 20 for much of the cycle but approaches 20 as the falling rate phase of drying is entered and the first trip point is approached. After drying is complete, the IR range signal settles back down to the original values well below 20. The relatively steady signal at the beginning of the cycle is due to uniformity of wet items that make up the load. The bump in the IR range is due to the non-uniformity in drying of the load since the dry items have a much higher temperature than the wet items which are being influenced by evaporative cooling. The steady signal after the load is dry is due to the uniformity of dry items that makeup the load 36.

A rough end of cycle determination can be made by filtering this signal and monitoring the initial values, the bump in the IR range, and the return of the signal to the initial values. This technique is robust to the absolute temperature of the load, and therefore a temperature setpoint because it is looking at the variations in the IR signal as opposed to the actual values. The maximum value of the bump in the IR range signal is the point of peak non-uniformity in the moisture content of the laundry, which is corresponds to the partially dry laundry state. At this point, some items are dry and some are still wet.

Figure 5:
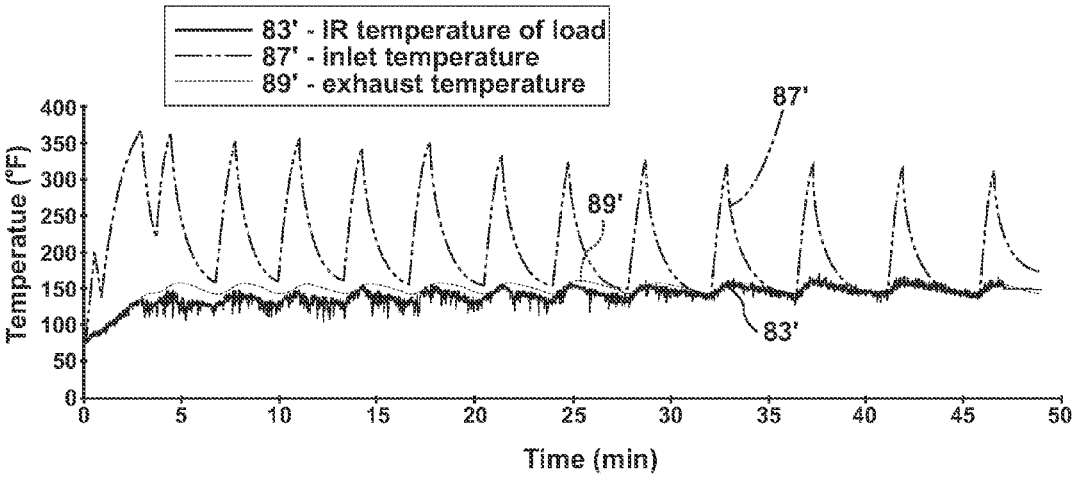
FIG. 5 is a graph of the temperature over time of a uniform 1.5 pound single-item, jean load, where the temperature is measured by various temperature sensors.

FIG. 5 is a plot of signals obtained from various sensors for a 1.5 pound jean load, where the load 36 is made of a single jean item. The various signals in FIG. 5 from the same sensors in FIG. 3 will be numbered with a prime ( ) subscript for the signal lines shown in FIG. 5. The variation in IR signal for the load temperature increases after the warm-up phase is completed and decreases once the load is close to being dry.

Figure 6:
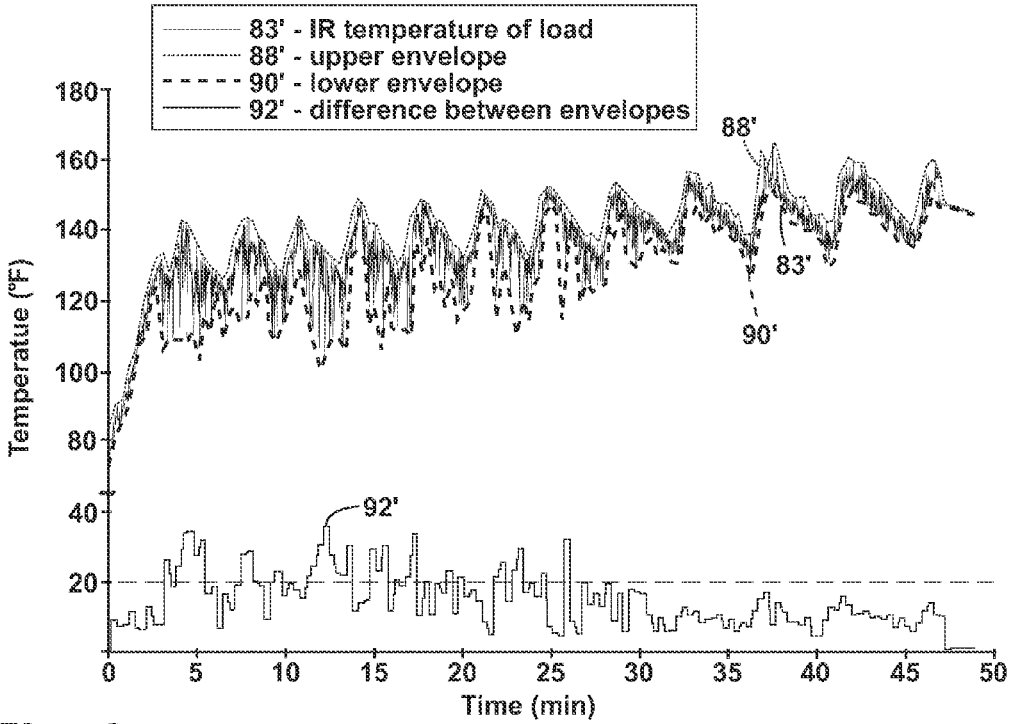
FIG. 6 is a graph with an IR signal analysis for the uniform 1.5 pound single-item, jean load of FIG. 5.

FIG. 6 illustrates IR signal analysis for the 1.5 pound jeans load, which is done in the same faction as the analysis of the 9 pound towel load described above. Once again, signals shown in FIG. 6 from the same sensors as signals 83, 88, 90 and 92 shown in FIG. 4 will be numbered with a prime ( ) subscript. It can be noted, the IR range calculation represented by the line 92 demonstrates values around 10 during the warm-up phase, increases to above 20 as the non-uniformity in drying increases, and then settles back out around 10 when the load has become dry. The current or maximum IR range signal 92 may be compared with a threshold, such as a partially-dry reference indicative of a portion of the laundry load being dry. An example of such partially-dry reference is a minimum threshold of about 20 for the IR range signal 92.

An accuracy of the analysis may be improved by filtering the IR range signal and monitoring the initial and the bump portions of the signal, whereby the peak non-uniformity point, i.e. the partially dry laundry state, may be found. Any typical methods to detect the maximum of the IR range signal may be used such as using the derivative to find the maximum.

Figure 7:
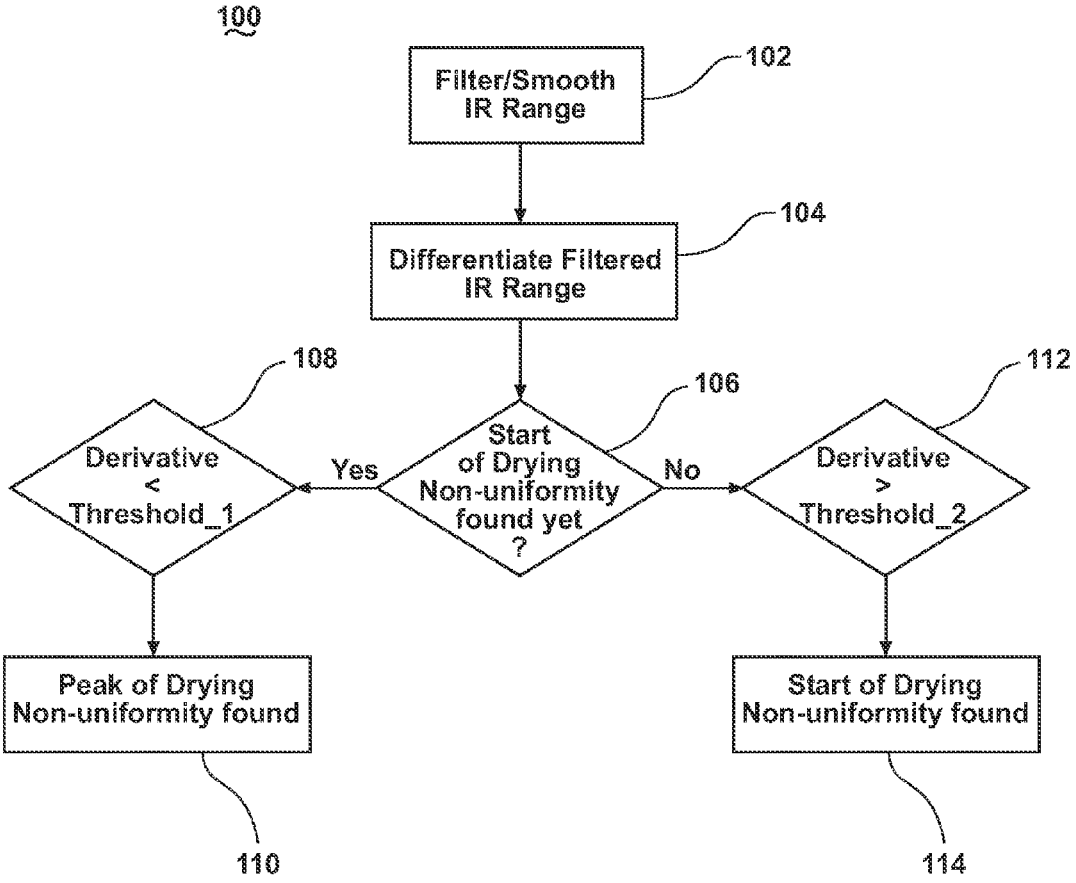
FIG. 7 is a flow chart illustrating a method of determining a partially dry laundry load state.

FIG. 7 illustrates one example 100 of determining the peak of drying non-uniformity point (i.e. the partially dry laundry state). It may start at 102 with filtering/smoothing the IR range signal, followed by differentiating the filtered IR range at 104. A determination of the beginning of a drying non-uniformity of the laundry load 36 may be made at 106. If it is determined that the drying non-uniformity has begun, then a derivative of the IR range signal may be compared with a threshold (Threshold_1) at 108. If the derivative is more than the Threshold_1, then the process may be repeated by returning to 102. If the derivative is less than Threshold_1, then the partially dry laundry state is determined at 110. Alternatively, if at 106 it is determined that the drying non-uniformity has not begun, than a derivative of the IR range signal may be compared with a threshold (Threshold_2) at 112. If the derivative is less than the Threshold_2, then the process may be repeated by returning to 102. If the derivative is more than Threshold_2, then the start of the drying non-uniformity of the laundry load 36 is determined. Values of the thresholds Threshold_1 and Threshold_2 may be predetermined numbers, for example, Threshold_1 may be selected from a range of −3 to −0.5, and the Threshold_2 may be selected from a range of 0.8 to 12.

The described two examples shown in FIGS. 3-6 are particularly difficult because each time the load 36 is made up of uniform fabric types which tend to dry in a uniform manner. Mixed loads which are very common for an average consumer will dry in an increasingly non-uniform manner which leads to a higher importance and easier detection of the partially dry laundry state.

Figure 8A:
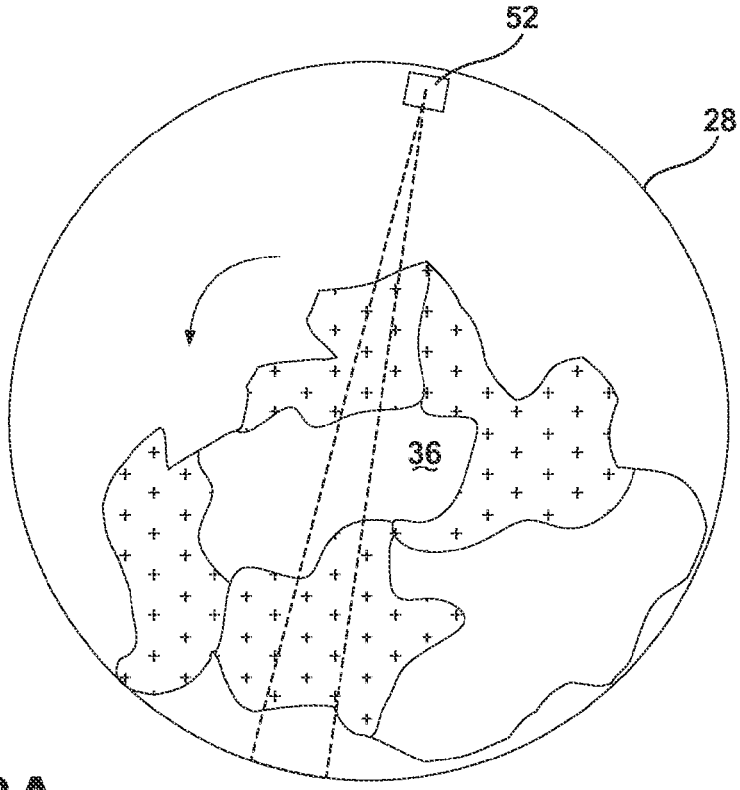
FIG. 8A is a schematic view of the drum of FIG. 1 with a mixed laundry load.
Figure 8B:
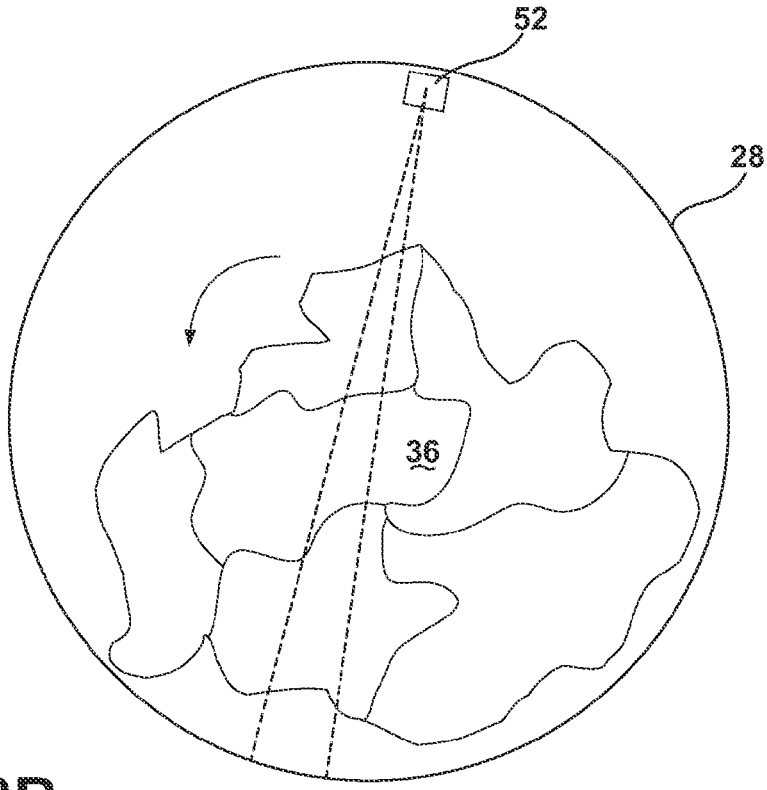
FIG. 8B is a schematic view of the drum of FIG. 1 with a uniform laundry load.

FIG. 8A illustrates the situation of a mixed load and FIG. 8B illustrates a uniform load. When the load is uniform, the garments will dry in a much more uniform manner as compared to a mixed load. This results in more consistent temperatures obtained by the IR sensor 52 as the load tumbles for the uniform load (FIG. 8B). That temperature is less consistent in case of the mixed load (FIG. 8A) or a bulky load. Loads of large and/or bulky items like comforters, sheets, etc, are usually made of a uniform material, but because they don't typically tumble well in the dryer due to their volume compared to that of the drum, they can dry in a very non-uniform manner.

Figure 9:
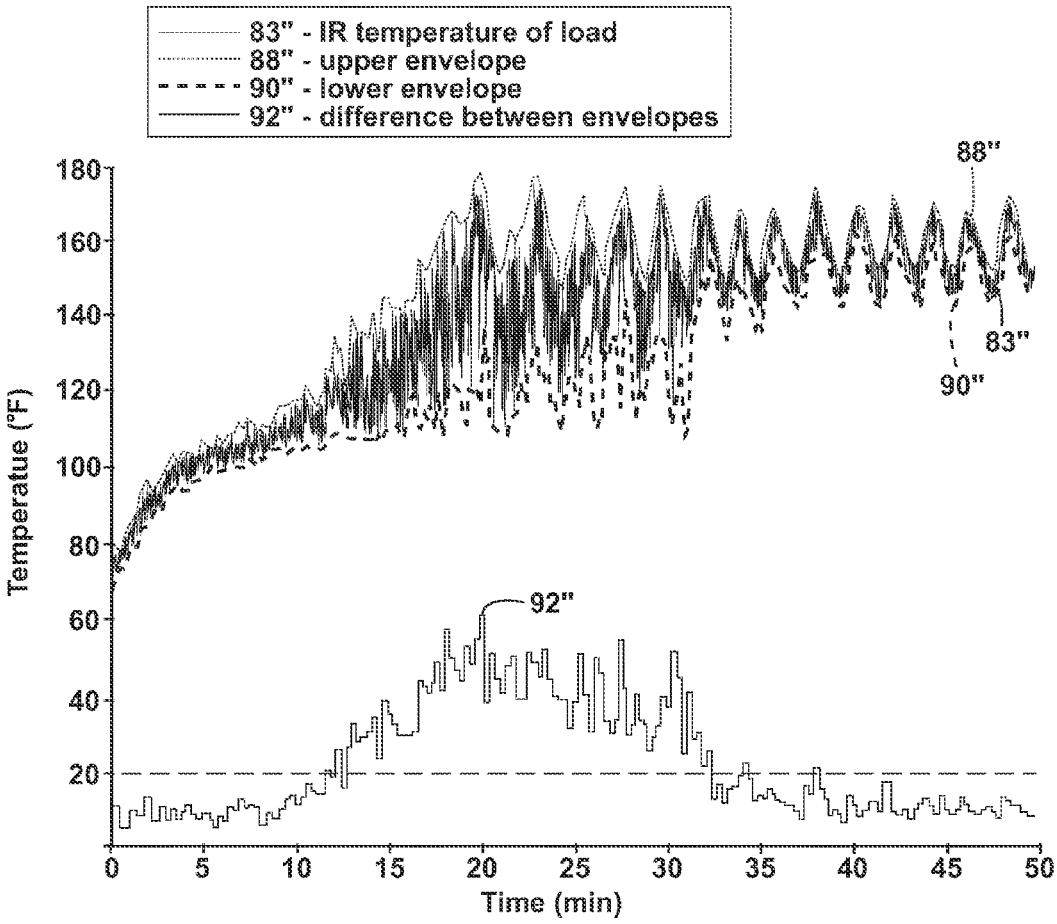
FIG. 9 is a graph with an IR signal analysis for a mixed 8 pound laundry load.

FIG. 9 shows the IR analysis for an 8 lb AHAM (Association of Home Appliance Manufacturers) load which is made up of different fabric types. Signals shown in FIG. 9 from the same sensors as signals 83, 88, 90 and 92 shown in FIG. 4 will be numbered with a double prime ( ) subscript. An increase in the non-uniformity due to the mixed load provides a much easier detection of the peak non-uniformity since the signal 92 is much more pronounced. At approximately 22 minutes, some of the items in the load are dry. When this peak is detected, or something proportional to it, a signal may given to the user that would allow them to remove dry items and let the cycle continue with the wet items. Once the cycle continued, a new peak could be observed which may lead to another signal if desired. This process may be continued any number of times.

If the load is sensed to be very uniform such as in the first two cases, then a decision could be made not to notify the user at all. This feature may also be selectable based on the user's needs. The same process could be used to notify the user in the situation that the load is large and/or bulky such as sheets or a comforter. In this case, the user may redistribute the load or the dryer may take some other action independent of the user such as redistributing based on drum control, or reversing, etc. More specifically, if a certain level of non-uniformity is found for any load or especially for large and/or bulky loads, one action the clothes dryer 10 may take would be to reverse a rotational direction of the drum 28 or change the drum speed to help redistribute the load 36. If fabric care is a concern then several actions may be taken. For fading, stain setting, or shrinkage concerns, the temperature setting may be lowered to decrease temperature based damage to the items that are already dry and/or the drum 28 may be paused, slowed, reversed, etc., to limit the mechanical action. On the other hand, if the load 36 is sensed to be very uniform, then the temperature setting may remain higher for a longer duration without damaging the load 36.

If minimizing cycle time is the goal then the temperature setting may be set at high until some non-uniformity (e.g. the peak non-uniformity) or particular dryness level is detected after which it may then be changed to a lower value to protect the already dry items or areas. The adjustment of the temperature setpoint may be continuous based on the level of non-uniformity sensed. If minimizing energy is the goal or there is a need for increased fabric care then the temperature setting or heater control scheme may be changed at a threshold prior to the peak non-uniformity point to limit the temperatures and energy consumption.

Rather than changing the temperature setting, the airflow may be modified to help regulate the fabric temperature. If lower or higher temperatures are needed the blower speed may be increased or decreased to get the desired temperature effect and may be able to maintain the drying rate/cycle time but gain a fabric care benefit.

For dispensing cycles, the non-uniformity may be detected and used to trigger when to stop dispensing or start dispensing depending on the purpose. For example, if the cycle called for dispensing (e.g. steam, fragrance, static reduction, etc.) then the peak non-uniformity or something proportional may be used as the trigger to start the dispensing portion of the cycle. Steam may also be used to help keep some of the dry items damp which may extend the cycle time but would have the benefit of preventing the dry items from reaching extreme temperatures if the heater setting is not changed.

If the peak non-uniformity is detected (or something proportional), the status of the end of cycle algorithms may be checked and at this point may be used as an adjustment, correction, or calibration of the algorithms. For example, if non-uniformity in drying is detected then the cycle may be stopped, thresholds may be modified, and/or the algorithm may enable, disable, or change the weighting of a particular algorithm. The cycle/display time estimation may also be updated at this point or adjusted for future cycles.

Moreover, if the laundry load 36 is detected to be small, then the drum speed may be changed to optimize the tumble speed for that load size which would typically be slower than the ideal speed for a larger load to prevent baffle riding. Additionally or alternatively, in case of a small load, the blower speed may be decreased to help limit the amount of blow-by air and dry the load faster and increase the drying efficiency of the clothes dryer 10.

In addition, the magnitude of the peak non-uniformity contains information regarding the difference in the fabric types that make up the load. In the uniform load cases (FIGS. 4 & 6), the magnitude of the peak non-uniformity was on average 22 or less vs. an average of almost 50 for the mixed load (FIG. 9). This indicates that for the mixed load, the garments that made up the load 36 were much more varied than for that of the uniform loads. If a load consists of items that are of the same type and condition, then the temperature variation will be small relative to that of a load which has some items that dry quickly and some that dry slowly. This again can be attributed to differences in the fabric types, weaves, thread counts, density, treatments/coatings, age, etc. As mentioned above, the determined load type information can be used to adapt or modify the behavior and/or an operational parameter of the cycle similarly as described above.

Figure 10:
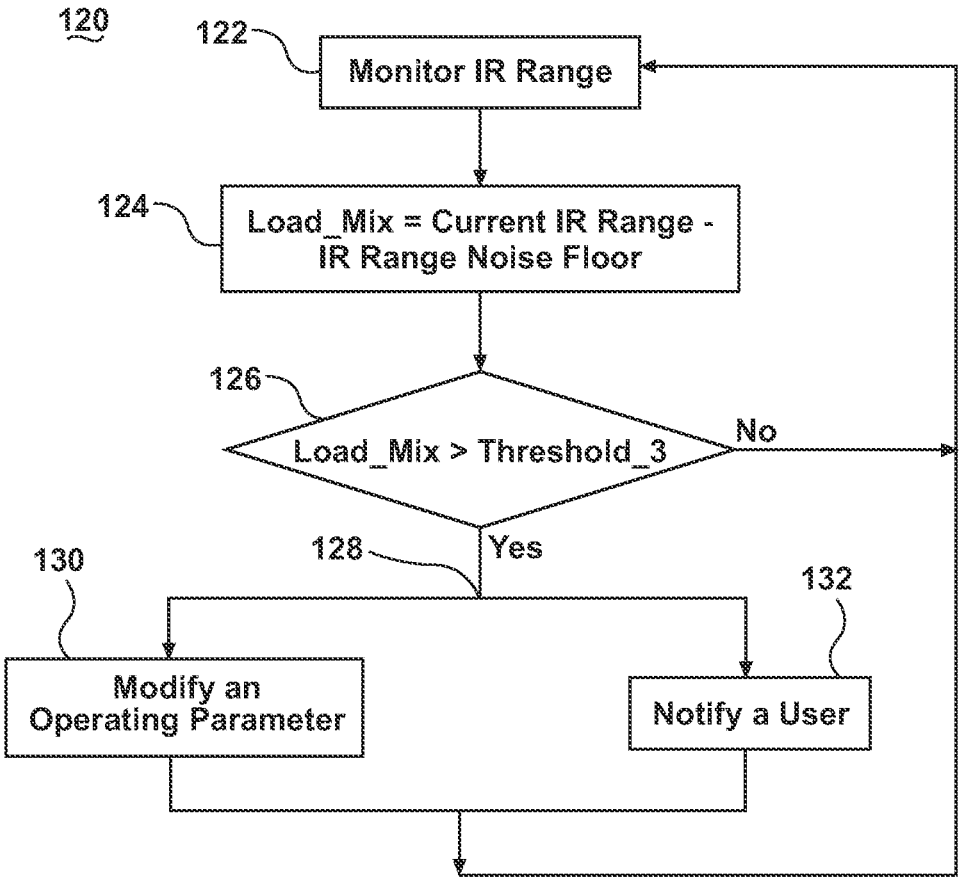
FIG. 10 a flow-chart illustrating a method of quantifying a mix of the laundry load.

FIG. 10 is a flow-chart illustrating a method 120 of quantifying a mix of the laundry load 36 in terms of dry rates. The method 120 may begin by monitoring the IR range 92 at 122. The mix of the laundry load determination may be triggered by the IR range crossing a certain threshold or a metric could be created that quantifies the mix of the load makeup (Load_Mix). Thus, at 124, the Load_Mix may be determined by subtracting the IR range from an IR range noise floor. The Load_Mix can be a continuous value that changes throughout the cycle verses time. The IR range noise floor may be determined for each specific cycle as the average IR range during the first few minutes of the cycle when the load temperature is uniform. This would help make the noise floor detection robust to variation in loads, machines, sensors, etc.

Once the metric quantifying the mix of the load makeup is determined to be higher than a predetermined threshold Threshold_3 at 126, then an operational action for the cycle of operation may be initiated at 128. The operational action may be to modify an operating parameter for the cycle of operation 130 and/or a decision to notify the user 132. Alternatively, if the Load_Mix is less than the predetermined threshold, it may be decided to not notify the user and/or to keep the behavior of the cycle unchanged, and to proceed to 122 for repeating monitoring the IR range.

Figure 11:
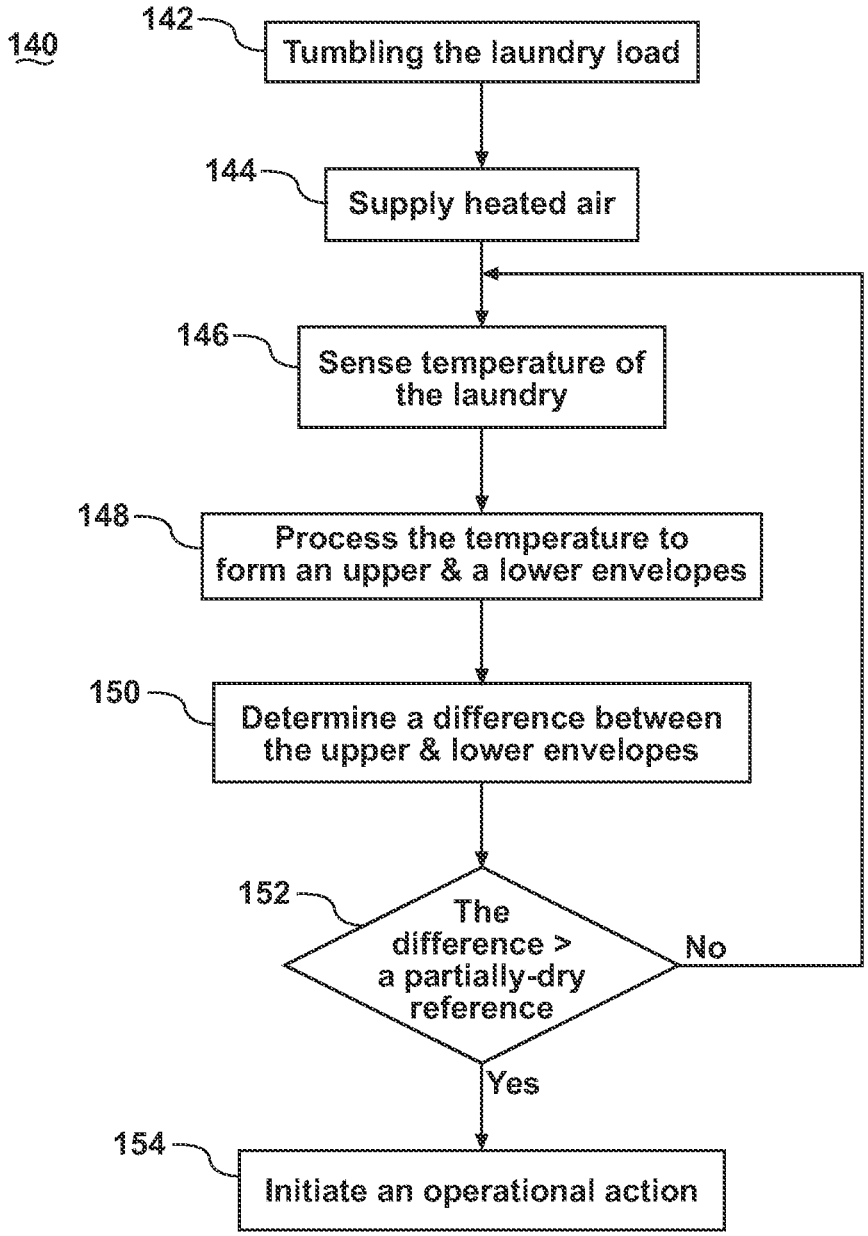
FIG. 11 a flow chart illustrating a method of according to one embodiment of the invention.

FIG. 11 is a flow-chart depicting a method 140 of operating a laundry treating appliance which includes determining the partially dry state of the laundry load 36 according to one embodiment of the invention. The method 140 may be carried out by the controller 14 using information inputted by the user via the user interface 16. The method 140 described herein may be implemented as an independent cycle or as part of another cycle of operation. The sequence of steps depicted is for illustrative purposes only and is not meant to limit the method 140 in any way as it is understood that the steps may proceed in a different logical order, additional or intervening steps may be included, or described steps may be divided into multiple steps, without detracting from the invention.

The method 140 may begin at 142 with an optional tumbling the laundry load 36 within the treating chamber 34 and optional supplying of the heated air to the treating chamber 34 at 144. Alternatively, the method 140 may begin at 146, where a surface temperature of the laundry load 36 is repeatedly sensed to form a temperature signal 83. The tumbling the laundry load 142 may have a pause in the tumbling and the repeatedly sensing the surface temperature 146 may occur at least during one pause. The sensing the surface temperature 83 of the laundry load may include sensing an average temperature of the surface of the laundry load 36. The sensing of the surface temperature of the laundry load may be accomplished by taking an infrared temperature reading by one or more IR sensor 52 described above.

The temperature signal 83 is processed to form an upper envelope 88 of the temperature signal and a lower envelope 90 of the temperature signal at 148. To form the upper and lower envelopes local maxima and minima may be determined, where the maxima may be used to form the upper envelope 88 and the minima may be used to form the lower envelope 90. At 150, a difference between the upper envelope and the lower envelope may be determined to form a difference signal 92. The determining a difference 92 may include determining a difference between the maxima and the minima or determining an average of the difference signal. The difference signal 92 may be repeatedly compared to a partially-dry reference indicative of a portion of the laundry load being dry at 152. The partially-dry reference may be a predetermined increase in the average of the difference signal or a predetermined increase in the difference signal 92. The repeated sensing a surface temperature of the laundry load described at 146 and the repeated comparing the difference signal to a partially-dry reference may be done in a continuing or discrete manner.

At 154, an operational action for the cycle of operation may be initiated when the comparison indicates the laundry load 36 is partially dry. Some non-limiting examples of initiating the operational action are: alerting the user of the partially dry laundry and determining a load type for the laundry load based on the difference signal 92. The determination of a load type may include determining a load type based on the magnitude of the difference signal 92. Also, the initiating an operation action may further include setting one or more operating parameter for the cycle of operation based on the determined load type. As described above, the operating parameter may be: a temperature setpoint(s), type and quantity of water or chemistry dispensing, tumble speed, airflow setpoint(s), end of cycle detection, etc, or a combination thereof.

Some conventional clothes dryers utilize some means of sensing the load to determine an optimal time to end the drying cycle. Most users prefer to start a selected cycle knowing that everything is dry at the end with no shrinkage, stain setting, fading, or other damage. This can be possible for uniform loads, but mixed load types however do not dry in a uniform manner because of differences in the fabric types, weaves, thread counts, density, treatments/coatings, age, etc. Even uniform loads can have some uniformity differences due to location in drum, tumble pattern, etc., but to a much lesser extent. This leads to situations where in order to dry all the items in the laundry load 36, some of them will need to be over dried and subjected to more heat and tumbling than is necessary which both can affect the life of the garment(s). Thus, the present invention solves the described difficulties, by providing method of determining when some of the items are dry. That information in any suitable form (for example audible, visual, electronic, etc.) may be provided to a user, who may then remove some of the items and allow the remaining items to finish as needed. This may be viewed as an additional step in the drying process, but it may prevent other steps like sorting or needing to run more washer/dryer cycles with the smaller sorted loads. That in time may also lead to energy savings because fewer loads would need to be run and the dryer could be operating closer to its peak efficiency as the efficiency suffers with smaller loads.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a laundry treating appliance having a treating chamber in which a laundry load is placed for treatment according to a cycle of operation, the method comprising:

tumbling the laundry load within the treating chamber;

supplying heated air to the treating chamber to dry the laundry load;

repeatedly sensing a surface temperature of the laundry load during tumbling to form a temperature signal;

processing the temperature signal to form an upper envelope of the temperature signal and a lower envelope of the temperature signal;

repeatedly determining a difference between the upper envelope and the lower envelope to form a difference signal;

repeatedly comparing the difference signal to a partially-dry reference indicative of a portion of the laundry load being dry; and initiating an operational action for the cycle of operation when the comparison indicates the laundry load is partially dry.

2. The method of claim 1 wherein the tumbling the laundry load comprises a pause in the tumbling and the repeatedly sensing the surface temperature occurs during the pause.

3. The method of claim 1 wherein the sensing the surface temperature of the laundry load comprises sensing an average temperature of the surface of the laundry load.

4. The method of claim 1 wherein the sensing the surface temperature of the laundry load comprises taking an infrared temperature reading of the surface of the laundry load.

5. The method of claim 1 wherein the forming the upper and lower envelopes comprises determining local maxima and minima and using the maxima to form the upper envelope and the minima to form the lower envelope.

6. The method of claim 5 wherein the determining a difference comprises determining a difference between the maxima and the minima.

7. The method of claim 1 wherein the determining a difference comprises determining an average of the difference signal.

8. The method of claim 7 wherein the partially-dry reference is a predetermined increase in the average.

9. The method of claim 1 wherein the partially-dry reference is a predetermined increase in the difference signal.

10. The method of claim 1 wherein the initiation of an operational action comprises alerting the user of the partially dry laundry.

11. The method of claim 1 wherein the initiating an operational action comprises determining a load type for the laundry load based on the difference signal.

12. The method of claim 11 wherein the determining a load type comprises determining a load type based on the magnitude of the difference signal.

13. The method of claim 11 wherein the initiating an operation action further comprises setting an operating parameter for the cycle of operation based on the determined load type.

14. A laundry treating appliance, comprising:

a rotating treating chamber for holding a laundry load for drying;

an air supply system for supplying air to the treating chamber and exhausting air from the treating chamber;

a heating system selectively operable to heat the air supplied to the treating chamber;

an infrared temperature sensor positioned to read the surface of the laundry load while in the treating chamber and outputting a temperature signal indicative of the surface temperature of the laundry load; and a controller receiving the temperature signal and executing a program to process the temperature signal to form an upper envelope of the temperature signal and a lower envelope of the temperature signal, determine a difference between the upper envelope and the lower envelope to form a difference signal, comparing the difference signal to a partially-dry reference indicative of a portion of the laundry load being dry, and initiating an operational action for the cycle of operation when the comparison indicates the laundry load is partially dry.

15. The laundry treating appliance of claim 14 further comprising a rotating drum defining the rotating treating chamber.

16. The laundry treating appliance of claim 15 wherein the air supply system comprises an inlet conduit fluidly coupling the treating chamber to the ambient air, and the heating system comprises a heating element located within the inlet conduit and operably coupled to the controller.

17. The laundry treating appliance of claim 14 further comprising a user interface operably coupled to the controller and the initiating an operational action comprises the controller activating an indicator on the user interface.

18. The laundry treating appliance of claim 17 wherein the indicator comprises at least one of a visual, electronic, and audible indicator.

19. The laundry treating appliance of claim 14 wherein the program further process the temperature signal to determine a load type for the laundry load.

20. The laundry treating appliance of claim 19 wherein the controller activates a load type indicator on a user interface indicative of the determined load type.

* * * * *